US006397761B1

(12) United States Patent
Moore

(10) Patent No.: US 6,397,761 B1
(45) Date of Patent: Jun. 4, 2002

(54) COMPUTER WORKSTATION

(75) Inventor: Lorraine Moore, Cameron, TX (US)

(73) Assignee: Balt, Inc, Cameron, TX (US)

( * ) Notice: Subject to any disclaimer, the term of this patent is extended or adjusted under 35 U.S.C. 154(b) by 0 days.

(21) Appl. No.: 09/586,519

(22) Filed: Jun. 2, 2000

(51) Int. Cl.[7] ..... A47B 37/00
(52) U.S. Cl. ..... 108/50.01; 108/147
(58) Field of Search ..... 108/50.01, 50.02, 108/50.11, 150, 147

(56) References Cited

U.S. PATENT DOCUMENTS 3,285,207 A 11/1966 Vom Hagen
4,401,036 A * 8/1983 Russo et al. ..... 108/150 X
5,078,414 A * 1/1992 Court et al. ..... 108/50.01 X
5,088,420 A 2/1992 Russell
5,174,223 A * 12/1992 Nagy et al. ..... 108/50.01 X
5,461,974 A * 10/1995 Reneau ..... 108/50.01 X
D393,382 S 4/1998 Rutter et al.
5,771,814 A 6/1998 Clausen
5,775,234 A 7/1998 Solomon et al.
5,778,799 A 7/1998 Eyre
5,806,943 A * 9/1998 Dell et al. ..... 108/50.01 X
5,845,587 A 12/1998 Ditonto
5,868,079 A 2/1999 Charny
6,158,357 A * 12/2000 Shih ..... 108/50.01
6,182,579 B1 * 2/2001 Chang ..... 108/50.01

* cited by examiner

*Primary Examiner*—Jose V. Chen
(74) *Attorney, Agent, or Firm*—Wendy Buskop

(57) ABSTRACT

An adjustable computer workstation comprising: a monitor support, a keyboard support; a computer support; a slidable column for vertically positioning the monitor support and the keyboard support; and piston structure with adjustment lever for vertically moving the keyboard support and the monitor support.

11 Claims, 6 Drawing Sheets

COMPUTER WORKSTATION

BACKGROUND OF THE INVENTION

1. Field of the Invention

The present invention relates to computer workstations in general and more particularly to such workstations that are ergonomically designed to provide adjustability accommodating a range of human dimensions from children to adults, and from females to males.

2. Description of the Prior Art

The science of ergonomics deals with the design of equipment and tools so as to make the equipment and tools easily used by the human user without undue fatigue. The ease of such use as well as the minimizing of strain and fatigue involves designing the tool and equipment to maintain proper orientation with the human user. As is readily apparent, the "human user" is a extremely variable entity and different individuals have varying height, reach, angular movement, and differ in various other dimensions all of which must be considered in the proper design of the equipment that the user will use or interface. This variation of human users has been outlined in tables created by THE HUMAN FACTORS SOCIETY INC. In this report, various anthropometric data are provided which represents the U.S. civilian body dimension for ages 20 to 60 years as determined by J. T. McConville of Yellow Springs, Ohio in his Anthropology Research Project and by K. W. Kennedy in his USAF-AMRL-HEG paper presented in 1985. The later paper is based on military data excerpted from the McConville Research Project of 1978.

Turing specifically to computer workstations and their monitor and keyboard supports of the type used in classrooms and in offices, the application of ergonomic design consisted, for the most part, of an attempt to provide compatibility of the monitor support with an user of normal or average anthropometric values. Adjustability of the video display screens consisted usually of making the screen tiltable to provide a good orientation of the video screen to the face of the user. The dimensioning of the user's height with respect to the monitor support retaining the screen, for the most part, consisted of a chair being vertically and rotationally adjustable. These adjustments, although providing a certain modicum of compatibility of the user to the workstation, left out certain other key factors dealing with the fatigue of the user such as proper angle angular orientation of the wrist with respect to the keyboard.

Another problem in user computer interfaces involved the poor or inadequate location of various status displays and actuators that may have to be user actuated in response to conditions viewed on the monitor screen by the user while inputting or monitoring computer data. Users today, have many items on their desks, or near their desks, and users in certain kinds of businesses, such as refineries or petrochemical plants may need to react as quickly as possible to certain adverse conditions during start-up and loading of setpoints and data into critically controlled systems. An alarm condition has to be quickly if not instantaneously acted upon. Prior art location of such actuators was usually somewhat removed from the video monitor and even when in relatively close proximity thereto, provided a poor viewing angle for the user preventing him from simultaneously viewing both the monitor and the actuator board.

Prior references which are different from the instant invention, but are incorporated herein by reference include Vom Hagen, U.S. Pat. No. 3,285,207, Russell U.S. Pat. No. 5,088,420, Clausen U.S. Pat. No. 5,771,814, Solomon U.S. Pat. No. 5,775,234, Eyre U.S. Pat. No. 5,778,799, Ditonto U.S. Pat. No. 5,845,587, and Charny U.S. Pat. No. 5,868,079. Eyre is directed to a computer workstation having a retractable keyboard, which is adjustable by means of pressurized gas cylinders. Solomon discloses a height adjustable overbed table having a gas spring with a gas cylinder for adjusting a table and caster wheels. Vom Hagen discloses an extensible support column for a table having a rod with a gas filled cylinder. Russell provides a height adjustable workstation with a slide out keyboard support and caster wheels. The means for adjusting the height are extendable supports. Clauses simply notes slide out keyboard trays. Ditonto discloses a workstation with manual height adjustable sections. Charny discloses a stand for a monitor and keyboard wherein the supports for the keyboard and monitor are adjustable manually. Also of note is Rutter, DE 393,382, which does not disclose pneumatic means to raise and lower the computer.

A computer workstation ergonomically designed to provide a plurality of supports integrally mountable on a support wherein the individual user monitor support provides a variable height keyboard support which can swivel or be extended horizontally or vertically, a monitor support that is adjustable vertically, horizontally and rotationally as well as being tiltable has been needed to provide a comfortable workstation adaptable to users in the range of 5% female to 95% male as defined in the anthropometric tables of THE HUMAN FACTORS SOCIETY INC. In addition, there is a need to have a workstation, which does not require lifting, or pressure to the back of the user. Accordingly, the present invention has been designed which enable pneumatic support of the weight, which is particularly usable, by handicapped employees or children who can not lift the weight of a typical monitor.

The prior art did not meet the needs of the computer industry for a true ergonomically designed computer workstation particularly for use by children who needed to be able to lift heavy computer monitors.

SUMMARY OF THE INVENTION

The present invention is directed to an adjustable computer workstation comprising: a monitor support, a keyboard support, a computer support, a slidable column for vertically positioning the monitor support and the keyboard support, and piston means with adjustment lever for vertically moving the keyboard support and the monitor support. In a preferred versions, the piston means includes a pneumatic piston having a shaft connected to the monitor support through mounting means at one end, to the keyboard support through mounting means at an upper portion of the shaft, and to the slidable column at the other end, with the shaft being vertically movable in response to the supply or venting of gas to the piston. In the most preferred versions, the slidable column is rectangular, but a square tube is also usable herein. The workstation is contemplated as being mounted on wheels, which may be locking, but it can be supported on non-moving legs. In an alternative embodiment, a backstop or security rail can be mounted on the monitor support, to prevent a monitor from falling over the edge if the workstation is positioned in a place, which is not against a wall. The invention also includes embodiments wherein the keyboard support is a moveable support further comprising means to extend, retract and swivel. Similarly, the monitor support can be a moveable support further comprising means to extend, retract and swivel. The direction of movement which can be provided by both the monitor support and the keyboard support can be horizontal, vertical and horizontal simultaneously, or movement in an arc-like manner of up to approximately 20 degrees with respect to the face of the monitor support. In an alternative embodiment, it is contemplated that a plurality of monitor supports or keyboard supports could be integral on the stand and interconnected to form a substantially semicircular configuration could be used on the same workstation.

Finally, it is contemplated that locking means for retaining a set orientation of the keyboard support(s) or monitor supports could be used. In addition, in a preferred embodiment, the piston means may pass through the computer support and be attachable to a base comprising cross braces and cross support members, upon which the wheels may alternatively be attached.

These and other aspects of the Applicant's present invention will be more clearly understood from a review of the following description of the Applicant's preferred embodiment when considered in conjunction with the appended drawings.

DESCRIPTION OF THE PREFERRED EMBODIMENT

Turning now to the Applicant's description of his preferred embodiment it will be understood that the mentioned embodiment is being disclosed herein not to limit the Applicant's invention thereto but to provide a description of one way of utilizing the Applicant's invention.

Figure 1:
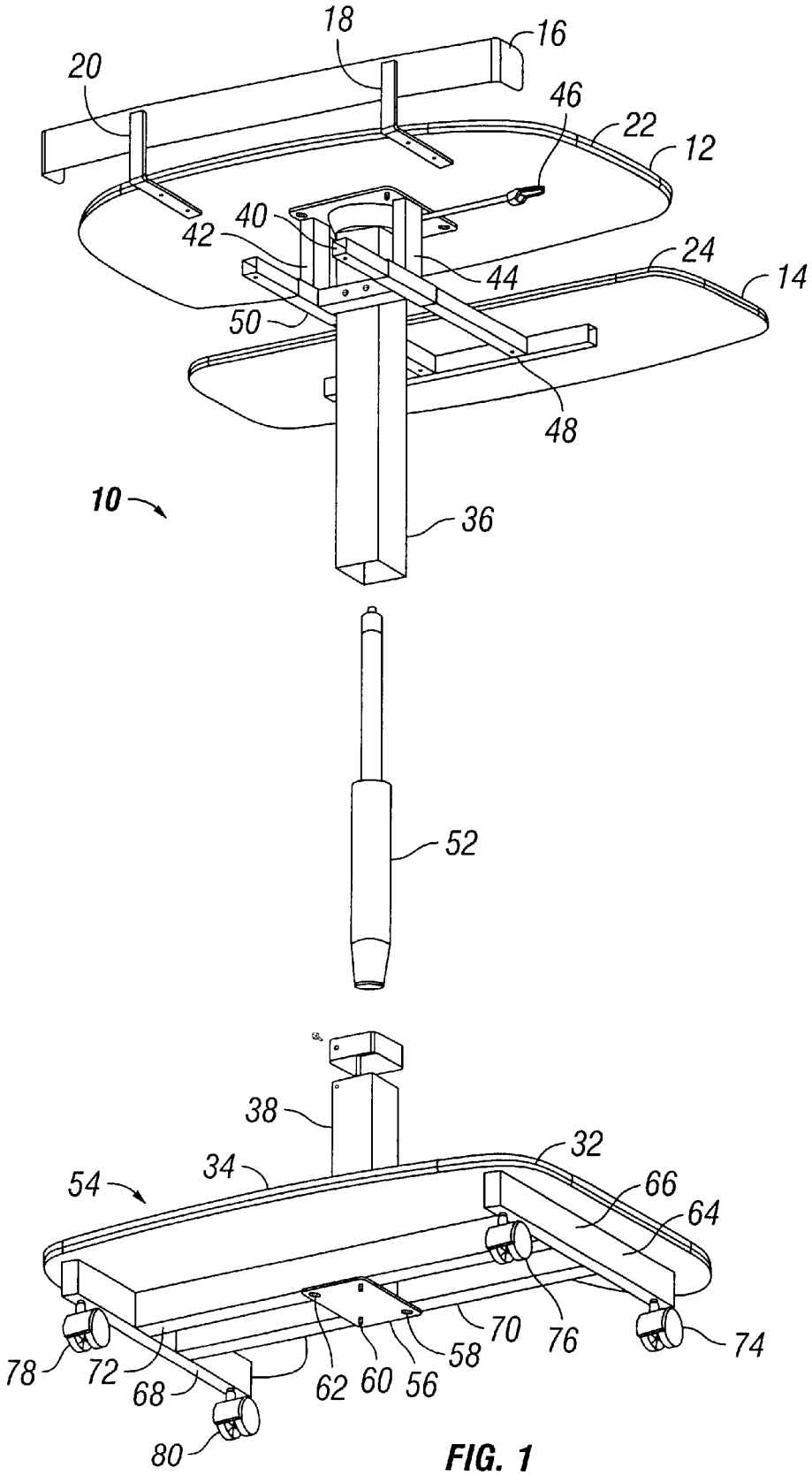
FIG. 1 is an exploded view of applicant's invention.
Figure 2:
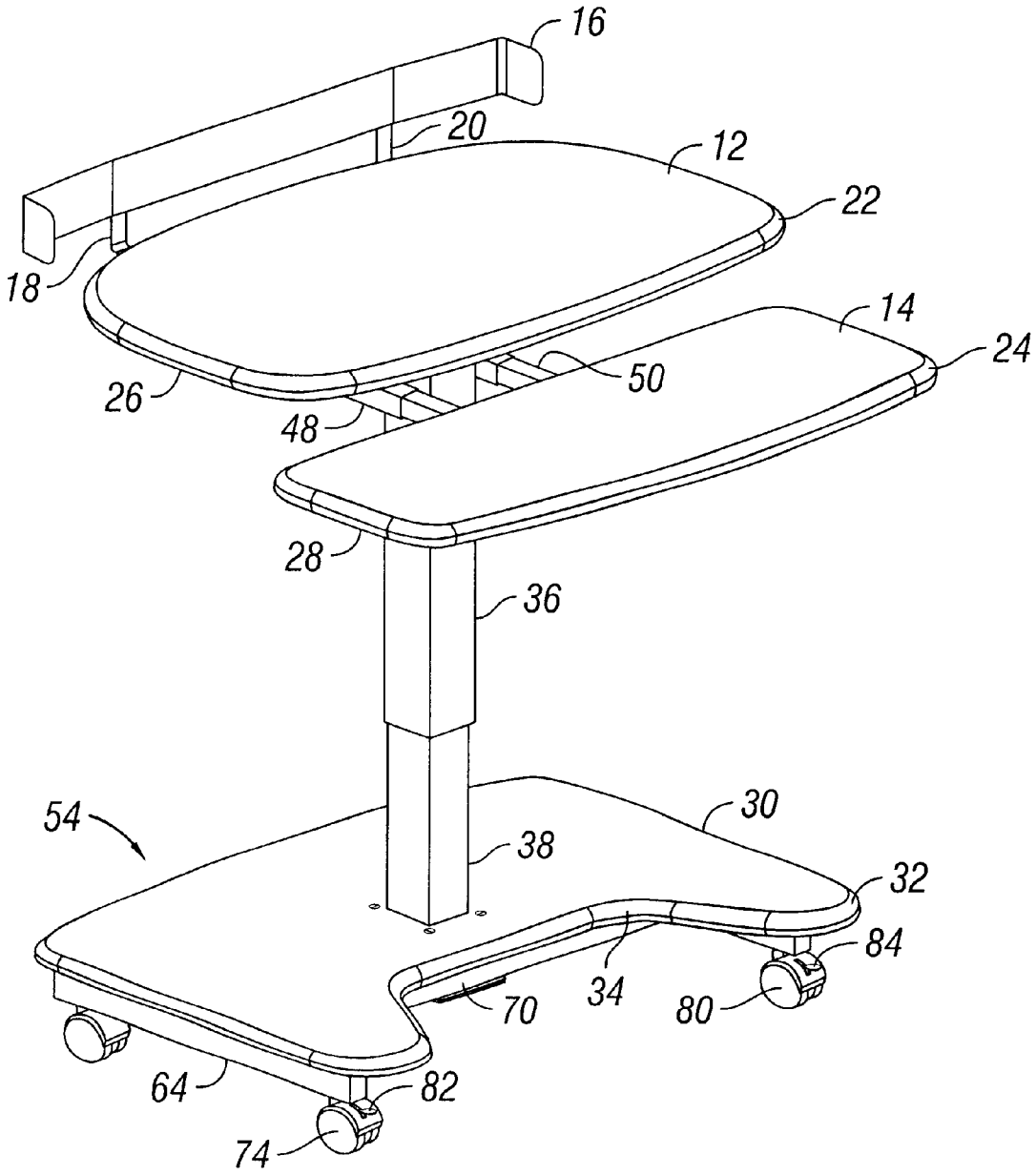
FIG. 2 is a perspective view of the Applicant's assembled invention.

With particular reference to FIGS. 1 and 2, a computer workstation (10) is shown which utilizes a monitor support (12), keyboard support (14) a security rail (16) mounted by first extension (18) and second extension (20). The computer workstation (10) also includes the computer support (30).

The surfaces of the monitor support (12), keyboard support (14). And computer support (30) are all manufactured to have a rounded edges (22), (24), and (32) respectively to prevent harming the user. In addition, all three supports have beveled edges, beveled edge (26) for the monitor support (12) and (28) for the keyboard support and (34) for the computer support. Additionally, a cut out is provided in the computer support to provide a comfortable foot area for the user.

The computer support (30) is shown as a stationary support. However, the monitor supports (12), which can be vertically alienable, and swiveled depending to the needs of the user. It will be understood that while the computer support (30) is shown as stationary it could just as easily be made moveable by mechanisms the same or similar to the mechanisms used to vertically align the monitor support (12) or keyboard support (14).

The workstation (10) provides both functionality as well as engineering design, which incorporate the most demanding ergonomic standards. The workstation provides case of usability, process information viewing as well as user interface which is efficient and can be easily modified to accommodate different human users including children or handicapped individuals who might be unable to lift computer monitors, due to their weight.

The monitor support (12) of the workstation (10) can be rotatably mounted or fixedly mounted to a slidable shaft, which comprises an upper slidable shaft member (36) and a lower slidable shaft member (38). If rotatably mounted, monitor support (12) can be attached by way of a pivot assembly (not shown) but which could comprise a pin mounted to one unit and a hinge to the other unit to pivotally connect the monitor support in a well known manner. Shown in FIG. 1, is a mounting means which includes a plate (40) which has a first monitor extension (42) and a second monitor extension (44) fixedly attached. Attached to the monitor extensions are extensions from the keyboard support (14). Keyboard support can feature a first extension (48) and a second extension (50) which adhere to the bottom side of the keyboard support (14). Extensions (48) and (50), in a preferred embodiment are slidable members, which interfit into sleeves that form an integral part of member (44) and (42). However, it is contemplated that other types of attaching means could be used with the keyboard to rotate, slide or move the keyboard into a proper rotational alignment for a user.

The monitor support (12) is vertically alignable using the pressure of the piston means shown in FIG. 1 as (52). The piston means, which is preferably a pneumatic cylinder, is actuated by a lever (46) which is secured into the plate (40). The pneumatic piston (52) is disposed inside both the upper slidable shaft member (36) and the lower slidable shaft member (38).

The pneumatic cylinder (52) enables a child or handicapped used to operate the level, and the monitor support (12) and accompanying keyboard (14) can be raised or lowered, accommodating the mentioned range of human users. Besides the vertical embodiment, the device may be rotatable within a 221/2 degree angles (rotational apparatus not shown) however, this embodiment enables accommodation, such as from a wheelchair with arms, which given certain wheelchair configurations, needs to be slightly rotated to be used. The viewing area and reach envelope of the user which may be limited by his particular field of vision and arm length. The reach envelope is critical in situations where the user may have to actuate actuators found in the enunciator units to control alarm conditions if the workstation is to be used by handicapped employees such as in a petrochemical or refining plant. The mentioned rotational angle is accommodated by use of a pivot assembly not shown which is contemplated to be mounted under the base of the monitor support or under the base of the keyboard support, or both.

Turning next to the base assembly (54), the base assembly (54) has in the most preferred embodiment, the computer support (30) through which the lower slidable shaft member (38) extends. In the most preferred embodiments, the slidable shaft members (36) and (36) are square, but a rectangular embodiment can be contemplated as within the scope of this invention. Lower slidable shaft member (38) is fastened to a plate (56) such as with conventional screws, shown as (58), (60), (62) and (64).

Plate (56) is affixed in the preferred embodiment to a base (64) comprising a first cross member support (66), a second cross member support (68), a first cross brace (70) and a second cross brace (72). Attached to the base (64) can be wheels, although it is not a requirement. The wheels can be locking wheels on all four wheels, here shown as (74), (76), (78) and (80), or two wheels can be locking wheels, and two can be movable. Alternatively, no locking mechanism need be added to the wheels, depending on the desires of the end user. Locking mechanism is shown as (82) on wheel (74) and (84) on wheel (80).

As was mentioned earlier. the computer support (30) has a cut away portion which is large enough to accommodate the feet of the users, or the wheelchair of the users.

Figure 3:
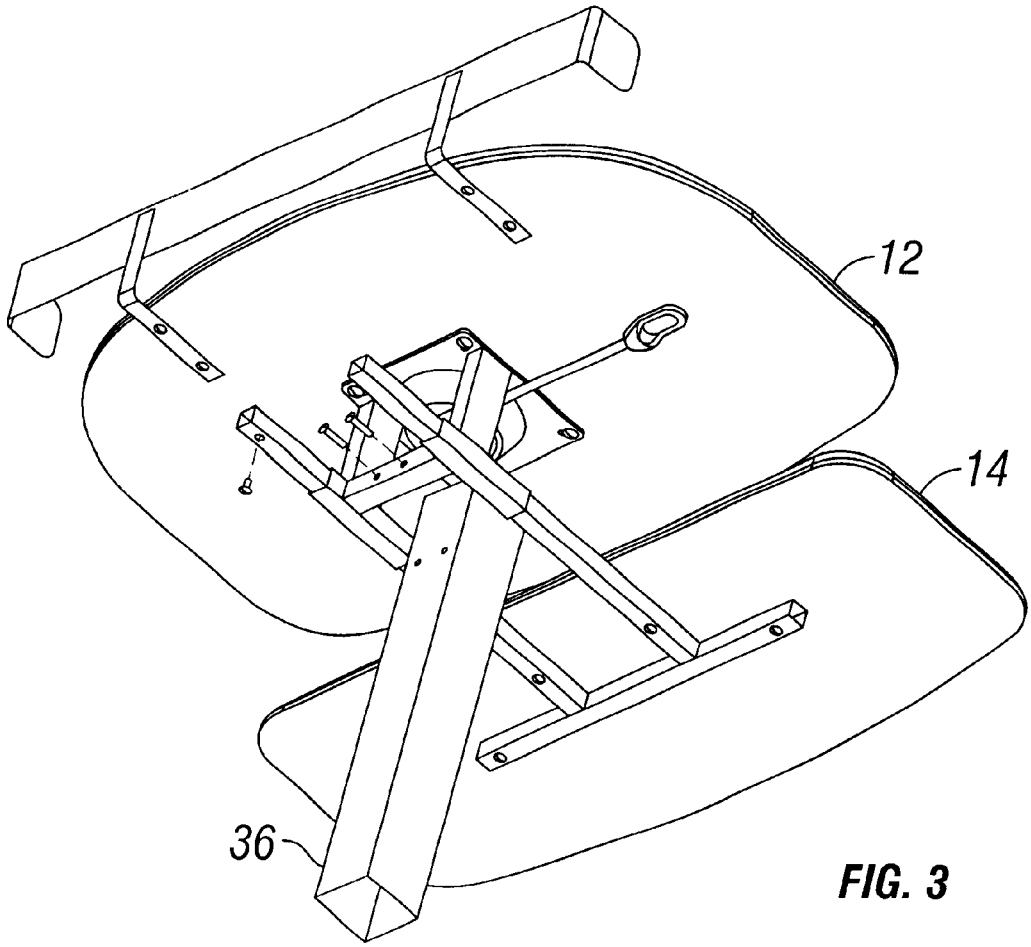
FIG. 3 is a view of the bottom of the monitor support with the keyboard support retracted.

FIG. 3 shows the bottom of a monitor support (12) and keyboard support (14) with the upper slidable shaft (36) detached from the monitor support just prior to attaching to the monitor support (12).

Figure 4:
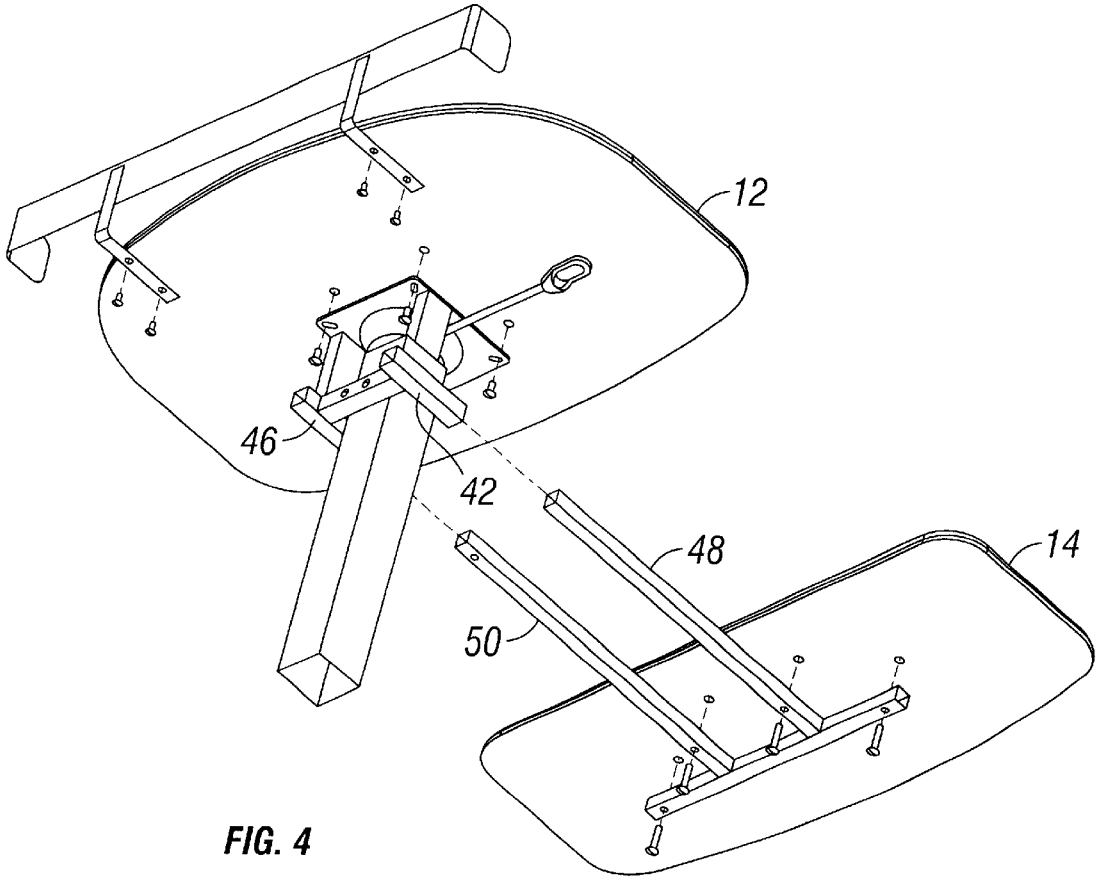
FIG. 4 is a view of the bottom Of monitor support of FIG. 3 showing one embodiment of the means for attaching the keyboard.

FIG. 4 shows monitor support (12) with keyboard support (14) and how the members (48) and (50) slide into members (42) and (46) for slidable horizontal adjustment of the keyboard support.

Figure 5:
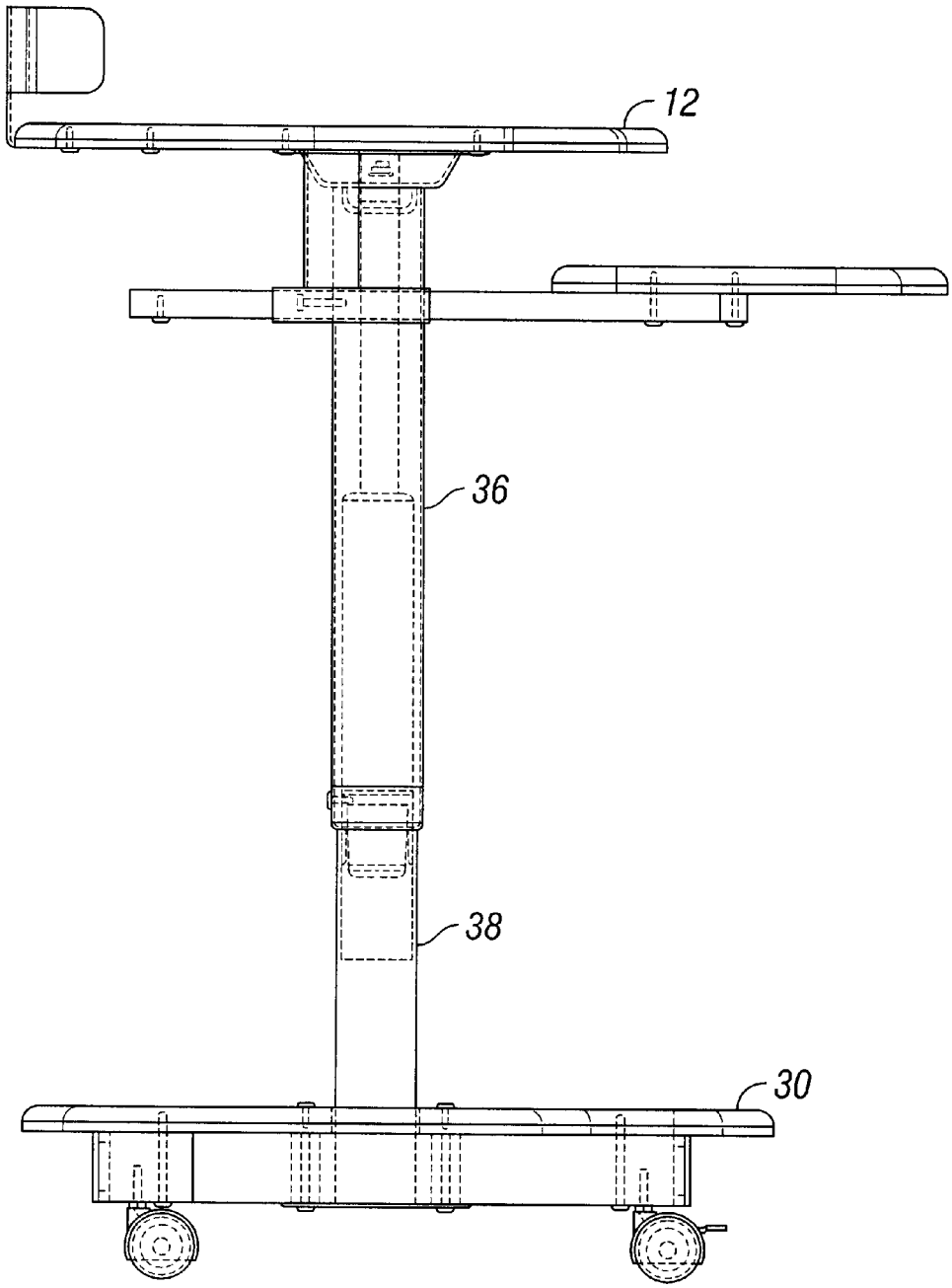
FIG. 5 is a cross sectional view of the upper portion of the slidable column extending over the bottom portion of the slidable column.

FIG. 5 shows a partial cross section of the lower slidable member (38) attached to the computer support (30) and an upper slidable member (36) attached to the monitor support (12), and how the slidable members interface with each other.

Figure 6:
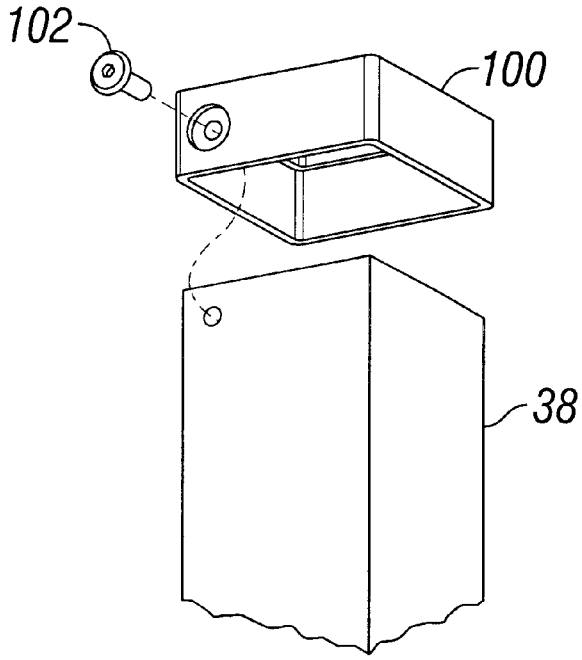
FIG. 6 is a detailed view of the top of the bottom portion of the slidable extendable column

FIG. 6 shows a detail view of the top of the lower slidable member (38) which in the preferred embodiment has a sleeve (100) disposed around the circumference of the slidable member which is attachable by any attaching means here shown as screw (102).

Figure 7:
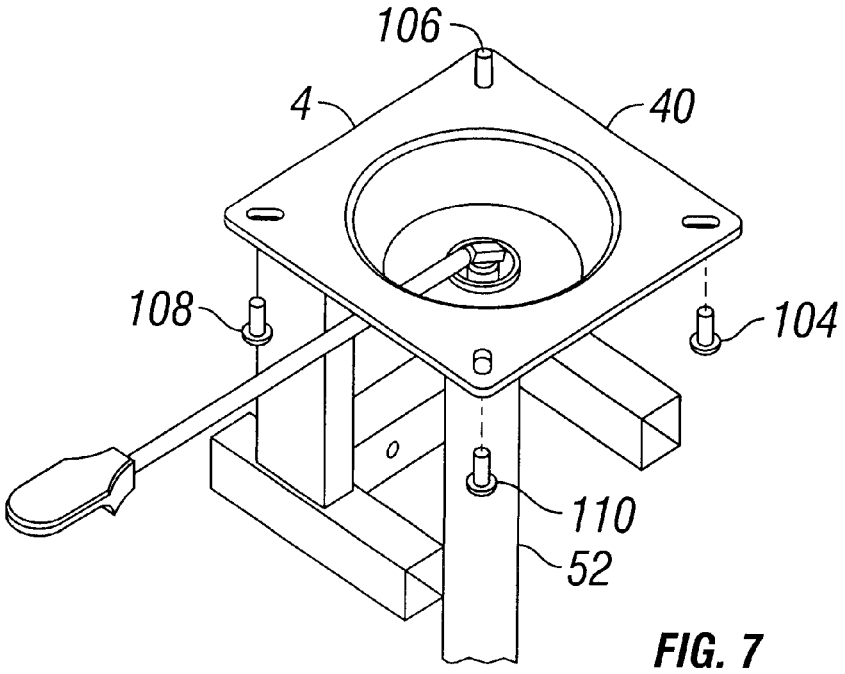
FIG. 7 is a perspective view a means for attaching the piston means to the monitor support.

FIG. 7 shows the plate (4) and the attaching means for affixing the plate to the monitor support, which is shown as screws (104), (108), (110) and (106). The plate attaches to pneumatic cylinder (52).

As an optional embodiment, the monitor support (12) may have openings (not shown) for providing electrical wireways connecting power and communications wiring between the monitor support (12) and adjoining monitor supports of (10) (not shown) or other equipment (not shown).

Certain additions and modifications will occur to people skilled in this art area. These additions and modifications have been deleted herein for the sake of conciseness and readability but are considered to be within the scope of the following claims.

What is claimed is:

1. An adjustable computer workstation comprising:

a monitor support;

a keyboard support;

a means to extend a monitor which is engaged with said monitor support and keyboard support;

a computer support;

a slidable column having a shape selected from the group comprising a rectangular shape and a square shape for vertically positioning said monitor support and said keyboard support;

pneumatic piston means with an adjustment lever for vertically moving said keyboard support and said monitor support; and wherein said monitor support and keyboard support move vertically simultaneously by being engaged with said means to extend a monitor and wherein said keyboard support is a moveable support further comprising means to extend and retract said keyboard support horizontally and secured to said means to extend a monitor.

2. The computer workstation of claim 1, wherein said pneumatic piston has a shaft connected to said monitor support through mounting means at one end, to said keyboard support through mounting means at an upper portion of said shaft, and to the slidable column at the other end, said shaft being vertically moveable in response to the supply or venting of gas to the piston.

3. The computer workstation of claim 1, wherein computer support is mounted on wheels.

4. The computer workstation of claim 3 wherein said wheels are locking wheels.

5. The computer workstation of claim 1, further comprising a security rail mounted on said monitor support.

6. The computer workstation of claim 1, wherein said means to extend further includes locking means for retaining a set orientation of said keyboard support.

7. The computer workstation of claim 1, wherein said means to extend said monitor, extends and retracts horizontal, or vertical and horizontal simultaneously, of the monitor support.

8. The computer workstation of claim 1, wherein said means to extend said monitor further includes monitor locking means for retaining a set orientation of said monitor support.

9. The computer workstation of claim 1, wherein said computer support is mounted on a base having a first cross base member, a second cross base member, a first cross member support, a second cross member support, and attaching means for securing said piston means to said base.

10. The base of claim 9, wherein said base is mounted on wheels.

11. The base of claim 10, wherein said wheels are locking wheels.

* * * * *